United States Patent [19]

Poole

[11] Patent Number: 4,899,827

[45] Date of Patent: Feb. 13, 1990

[54] OIL WELL FIRE CONTROL SYSTEM

[76] Inventor: Douglas Poole, 19327 Gage Lake La., Houston, Tex. 77084

[21] Appl. No.: 326,514

[22] Filed: Mar. 21, 1989

Related U.S. Application Data

[63] Continuation-in-part of Ser. No. 226,818, Aug. 1, 1988, abandoned.

[51] Int. Cl.[4] ..... A62C 35/12

[52] U.S. Cl. ..... 169/69; 166/364

[58] Field of Search ..... 169/47, 69; 166/328, 166/329, 364; 137/512.5, 539

[56] References Cited

U.S. PATENT DOCUMENTS

| | | | |
|---|---|---|---|
| 730,085 | 6/1903 | Berg | 137/512.5 |
| 1,958,155 | 5/1934 | Watkins | 137/512.5 |
| 2,138,988 | 12/1938 | Thomas | 137/512.5 |
| 3,763,936 | 10/1973 | Menage | 169/69 |
| 4,316,506 | 2/1982 | Poole | 169/69 |
| 4,337,831 | 7/1982 | Thaxton | 169/69 |

*Primary Examiner*—Sherman D. Basinger
*Assistant Examiner*—Stephen P. Avila
*Attorney, Agent, or Firm*—James A. Bargfrede

[57] ABSTRACT

A system and apparatus are provided for delaying ignition or extinguishing an oil well rig fire through the injection of pressurized carbon dioxide, nitrogen, monoammonia phosphate, or Monnex into the flow of hydrocarbons from the drill pipe and casing through a spool apparatus located above the "Hydril" and blowout preventers and above the casing but preferably below the mud return line, with untreated water being used as a back-up fluid after the chemicals have been dissipated. Such untreated water is inexpensive, readily available in most instances, and abundant in quantity. Such spool apparatus is equipped with a plurality of novel check valves which allow flow of chemicals upon actuation of the system while shutting off the flow of untreated water. After the chemicals have been dissipated, the novel check valves allow untreated water to flow into the system. The entire system may be activated by a mechanism at the control head of the well.

1 Claim, 3 Drawing Sheets

OIL WELL FIRE CONTROL SYSTEM

This application is a continuation-in-part of application Ser. No. 07/226,818 filed Aug. 1, 1988 and entitled "Blow-Out Safety System" now abandoned.

BRIEF SUMMARY OF THE INVENTION

The present invention provides a system and apparatus for delaying the ignition of fire at a well site or the extinguishing of a fire at a well site. Spool apparatus is positioned at the well site above well-known and well-utilized blow-out preventors and above the "Hydril" but below the mud return line. Spool apparatus is equipped with a plurality of check valves for receiving a plurality of conduits for transporting chemicals in a storage area to such spool apparatus. Also provided is a source of water which may be untreated insofar as distillation or chemical additives is concerned and such source of water is utilized when and if the chemicals are dissipated. A novel check valve has been developed for incorporating into the present system to allow the water to be delivered after chemicals from the storage tanks have been dissipated.

DETAILED DESCRIPTION

Figure 1:
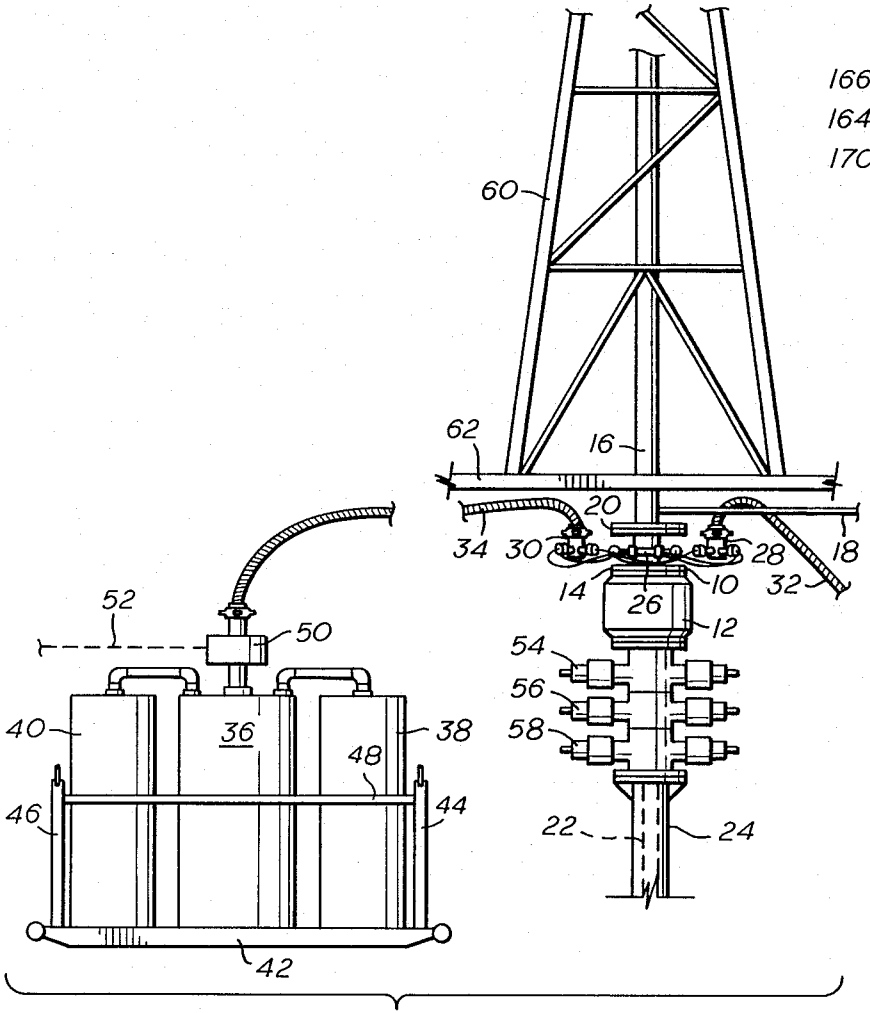
FIG. 1 is a side, elevational view of a well drilling rig showing installation of the spool apparatus and storage tanks of the present invention.

FIG. 1 is a side, elevational view of a well drilling rig showing installation of the spool apparatus and storage tanks of the present invention.

Spool apparatus 10 is connected above the "Hydril" 12 with a steel ring flange 14 on the bottom of the spool apparatus 10. The spool apparatus 10 is attached to the mud return line 16 below the mud return nipple 18 with a steel ring flange 20.

It will be appreciated that the spool apparatus 10 is positioned in vertical alignment as part of the "Stack" to the Hydril 12 and the mud return line 16 so that the drill string 22 in the drill pipe casing 24 maybe accommodated.

Positioned on the spool apparatus 10 circumferentially 90 degrees from each other are check valves 26 for a total of four check valves around the circumference of the spool apparatus 10. As will be explained in detail subsequently, coupling 28 and coupling 30 are connected to line or conduit 32 and conduit 34. Conduit 32 is connected to a water supply source (not shown) and conduit 34 is connected to a plurality of storage tanks such as storage tank 36, 38 and 40. These storage tanks may be positioned on a trailer or skid 42 having support members such as vertical support 44 and vertical support 46. Horizontal member 48 may be connected between vertical support 44 and 46 to stabilize and contain the storage tanks.

A control head 50 is positioned above tank 36 and when control head 50 is manually actuated or activated through means such as an electrical impulse in line 52 allows chemicals stored in storage tanks 36, 38 and 40 to be fed through line 34 to the spool apparatus of the present invention.

It will be appreciated that the present invention provides improvements over the system disclosed in my U.S. Pat. No. 4,316,506 issued Feb. 23, 1982 for "Oil Well Blow-out Safety System". As explained in the '506 patent, chemicals which are stored in the storage tanks 36, 38 and 40 may be carbon dioxide, nitrogen, monoammonia phosphate, and Monnex, a registered trademark of Imperial Chemical Industries of Wilmington, Delaware for carbamic powder, a dry chemical extinguishant formulated from a reaction product of potassium bicarbonate and urea. Optimum pressure and quanities of carbon dioxide, nitrogen, monoammonia phosphate, and Monnex will vary according to field conditions and various requirements at particular well locations. In referring the the '506 patent it will be appreciated that although not explained previously, the "Hydril" 12 is positioned above a plurality blow-out preventers such as 54, 56, and 58.

The '506 patent sets forth in detail when and why fires occur on drilling rigs and it will be appreciated that the present invention is directed toward improving the extinguishing or the delaying of fire at a well site. More specifically, the conduit 32 provides a source of water which may be utilized when the chemicals in storage tanks 36, 38 and 40 have been dissipated.

The drilling rig utilized in practicing the present invention includes a frame 60 positioned on a floor 62.

Figure 2:
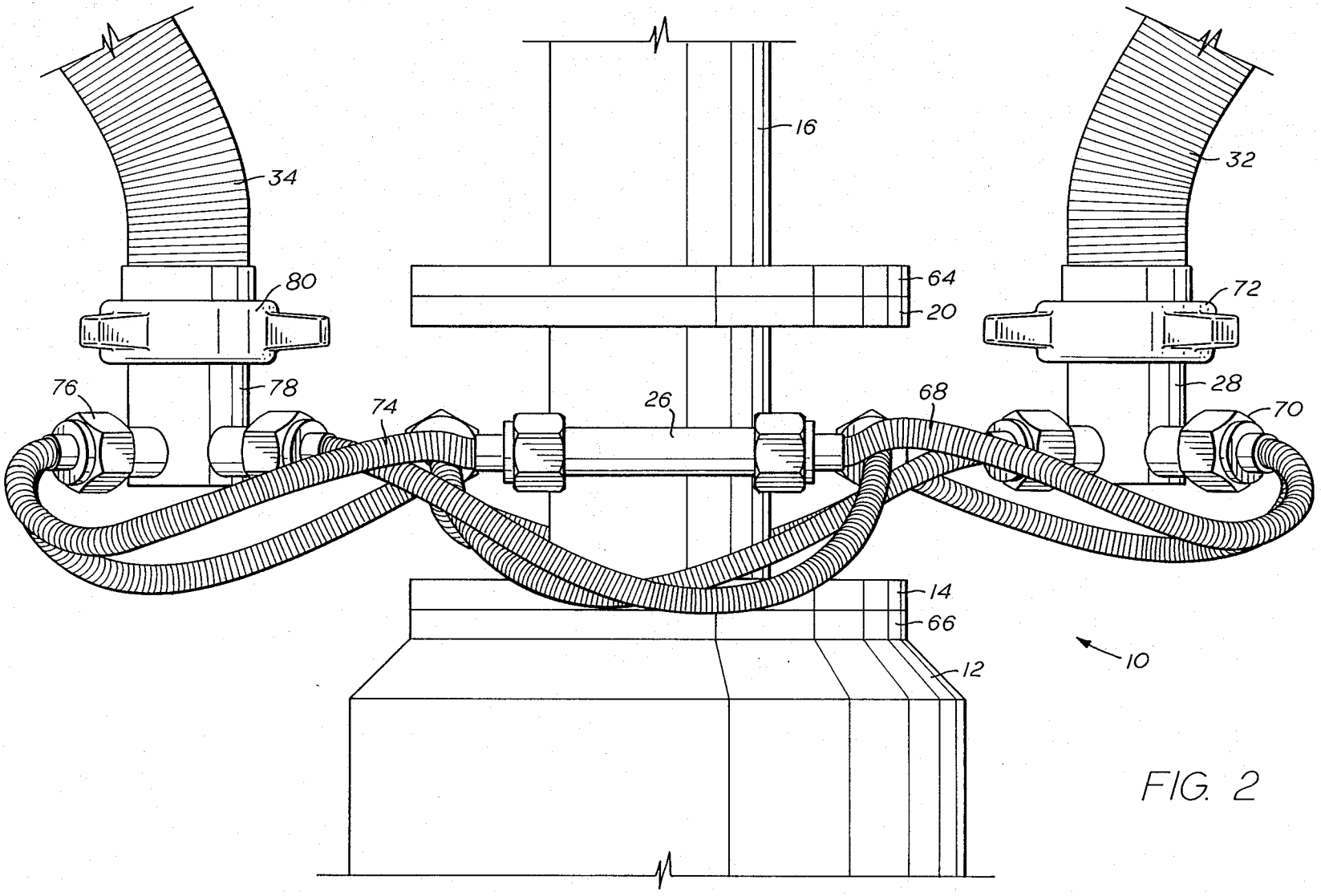
FIG. 2 is an enlarged side, elevational view of the spool apparatus shown in FIG. 1.

FIG. 2 is an enlarged side, elevational view of the spool apparatus shown in FIG. 1. Mud return line 16 has spool apparatus 10 positioned below flange 64 which is adjacent and connected to steel ring flange 20 of spool apparatus 10. Steel ring flange 14 of spool apparatus 10 is adjacent and connected to flange 66 on Hydril 12.

Spool apparatus 10 includes a plurality of check valves such as check valve 26. There are four check valves utilized in the embodiment of the invention shown and described. Check valve 26 is connected through line 68 which goes to connector 70 on coupling 28 which is connected to conduit 32. A suitable union 72 connects coupling 28 and conduit 32.

Similarly, line 74 from check valve 26 goes to connector 76 on coupling 78 which is connected to conduit 34 with union 80. Other lines similar to line 68 and line 74 are partially visable in FIG. 2 but, for simplicity reasons, the operation of check valve 26 only will be explained in connection with FIG. 2.

As explained in connection with FIG. 1, conduit 34 provides chemicals for delaying ignition of a fire or for the extinguishing of a fire which may have started. When the chemical supply through conduit 34 has been dissipated, a source of water is provided through conduit 32 to actuate check valve 26 so that water is provided instead of chemicals to extinguish the fire at the well site. As will be explained further in connection with FIG. 3, the other three check valves and their associated lines act to allow water to be used to extinguish the fire at the well site after the chemicals have been dissipated.

Figure 3:
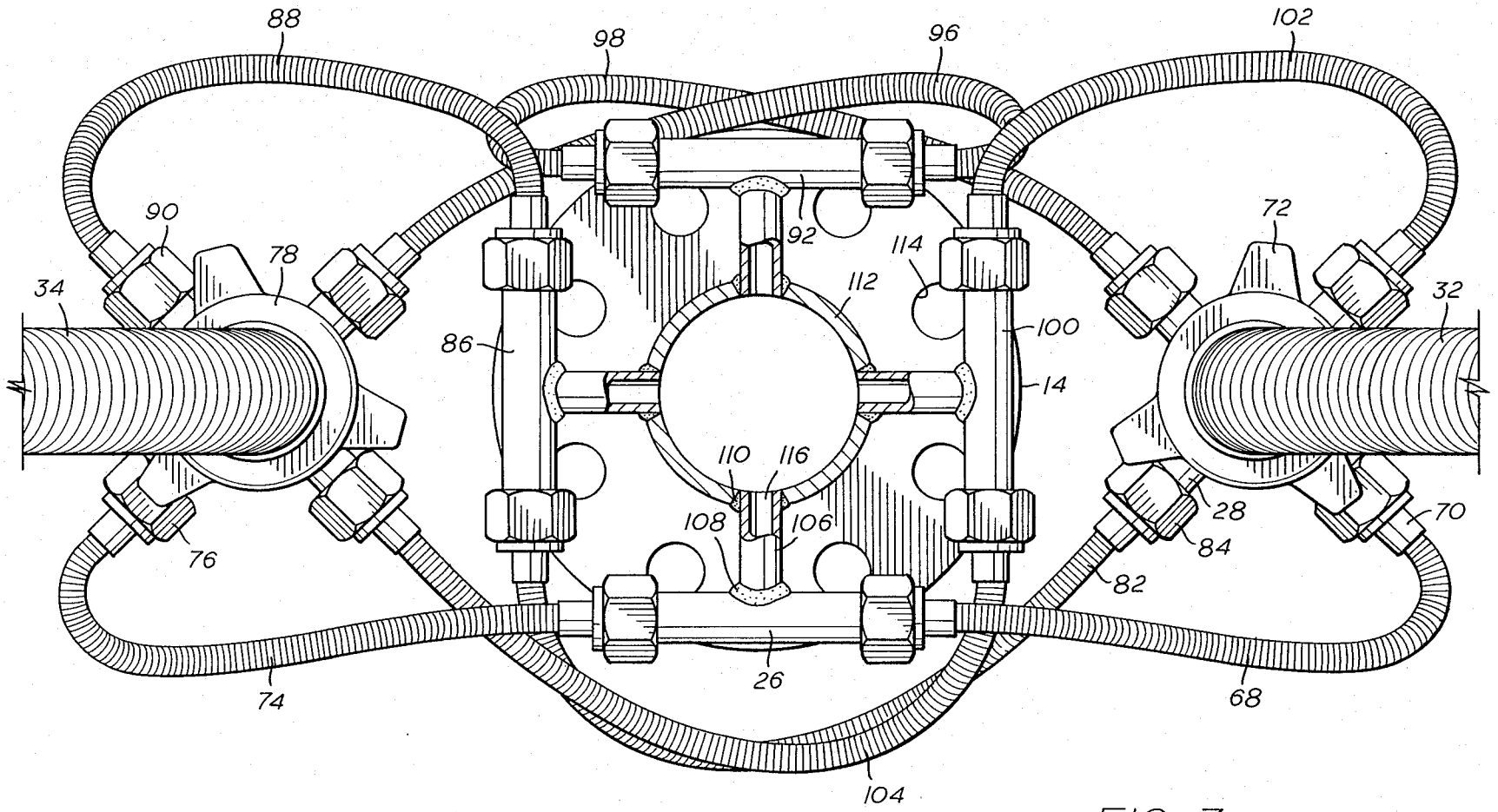
FIG. 3 is top, partial sectional view of the spool apparatus shown in FIG. 2.

FIG. 3 is a top, partial sectional view of the spool apparatus shown in FIG. 2. Conduit 32 is shown connected to union 72 which is connected to coupling 28. Connector 70 has line 68 connected thereto and goes to check valve 26 as explained in connection with FIG. 2. Line 82 is connected to connector 84 and to check valve 86. Line 88 is connected from check valve 86 to connector 90 on coupling 78 which is connected to conduit 34 as explained previously. The actuation of check valve 86 to provide water after the chemicals have been dissipated is the same as explained in connection with check valve 26. As explained in connection with FIG. 2, line 74 connects check valve 26 to coupling 78 through connector 76. Check valve 92 is connected through line 96 to coupling 78 and through line 98 to coupling 28. Check valve 100 is connected through line 102 to coupling 28 and through line 104 to coupling 78.

Check valve 26 has a cylindrial member 106 welded with weld 108 and weld 110 to member 112 of spool apparatus 10. Steel ring flange 14 is shown with a plurality of openings such as opening 114 to allow connection of the spool apparatus 10 to the Hydril as explained previously. Operation of the check valves 26, 86, 92, and 100 is an important feature of the present invention because such operation allows water to pass through openings such as bore 116 in cylindrical member 106 after chemicals have been used but have been dissipated. Fire may be prevented by using water but generally chemicals are more effective in extinguishing a fire at the well site.

Figure 4:
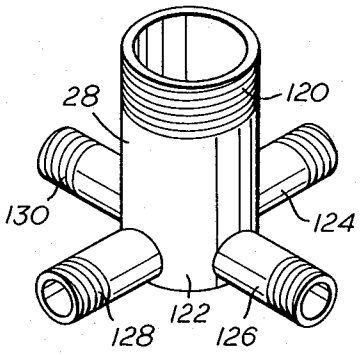
FIG. 4 is an upper, perspective view of a coupling used with the flexible conduits or hoses which provide chemicals and water to the spool apparatus.

FIG. 4 is an upper, perspective view of a coupling used with the flexible conduits or hoses which provide chemicals and water to the spool apparatus 10. The coupling shown in FIG. 4 may be coupling 28, for example, and has threads 120 at the upper portion of cylindrical member 122. Four members 124, 126, 128 and 130 are positioned at the lower portion of cylindrical member 122 and are equidistant from each other at an arcuate angle of 90° from each other.

Figure 5:
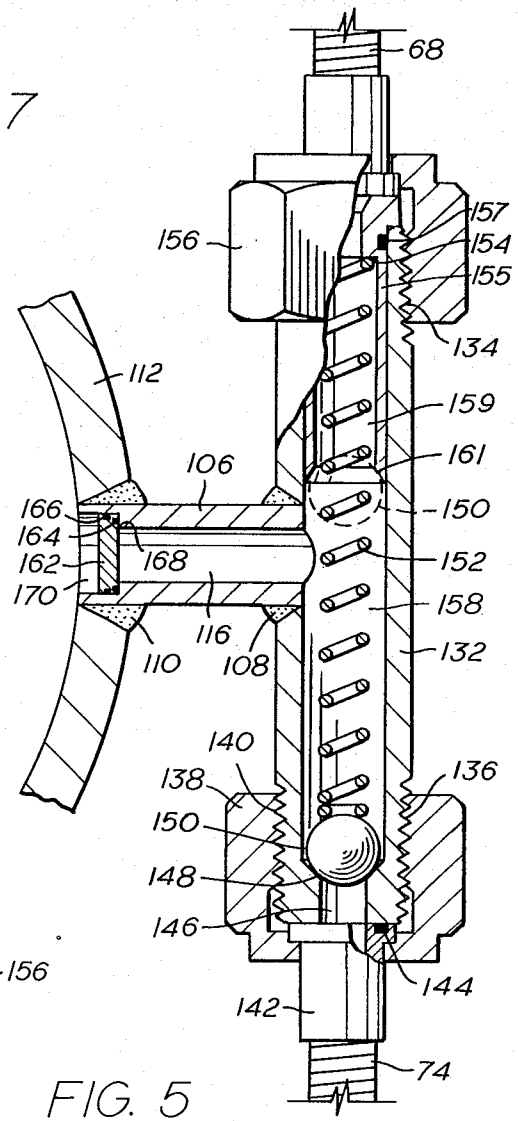
FIG. 5 is an elevational, partial sectional view of the novel check valve utilized in the present invention.

FIG. 5 is an elevational, partial sectional view of the novel check valve utilized in the present invention and may be, for example, check valve 26 which has been explained in use previously. Check valve 26 includes a cylindrical member 132 having threads 134 and 136 at each end. A connector 138 having threads 140 is threadedly connected to cylindrical member 132. Line 74 is connected to connector 138 with nipple 142. Nipple 142 has an O-ring 144. Orifice 146 includes a seat 148 having a ball 150 which may be steel. Ball 150 is held or positioned on seat 148 with a spring 152 having one end positioned on ball 150 and the other end positioned on shoulder 154 of bushing 155 having an O-ring 157 within connector 156. Connector 156 joins line 68 to cylindrical member 132 having spring 152 positioned in bore 158 and in bore 159 of bushing 155.

Bore 158 is in communication with bore 116 of cylindrical member 106 which is connected to cylindrical member 132 with weld 108 and to member 112 with weld 110. Plug 162 having O-rings 164 and 166 is positioned on shoulder 168 of the large diameter portion 170 of bore 116.

It will be appreciated that bore 116 provides chemicals from line 74 upon actuation of the control head 50 shown in FIG. 1. The pressurized chemicals in line 74 cause ball 150 to move from seat 148 by compressing or contracting spring 152 and ball 150 is positioned on seat 161 to block the passage of water from line 68. When there is no more pressure in line 74 from the source of chemicals, spring 152 causes ball 150 to move into seat 148 and water from line 68 goes through bore 158 and bore 116. Thus, the check valve shown in FIG. 1 allows pressurized chemicals to pass from line 74 through bore 158 and bore 116 and ruptures the plug 162. When the pressurized chemicals have been dissipated, water from line 68 passes through bore 158 and bore 116.

Figure 6:
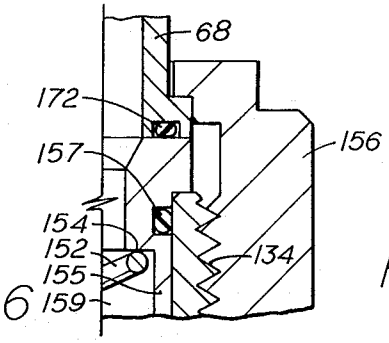
FIG. 6 is an elevational, sectional enlarged view of the water supply end of the check valve of FIG. 5.

FIG. 6 is an elevational, sectional enlarged view of the water supply end of the check valve of FIG. 5. Spring 152 is positioned on shoulder 154 of bushing 155 having O-ring 157 and O-ring 172 on line 68 within connector 156 having threads 134. As explained previously, water in line 68 passes through bore 159 when ball 150 is not positioned on seat 161. Plug 162 prevents water from passing through bore 116 until the system is activated and chemicals pass from line 74 through bore 116 while water is shut off when ball 150 is positioned on seat 161.

Figure 7:
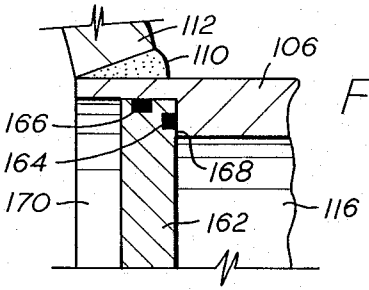
FIG. 7 is an enlarged view of the structure of the connection of the check valve shown in FIG. 5.

FIG. 7 is an enlarged view of the structure of the connection of the check valve shown in FIG. 5. Cylindrical member 106 is joined to member 112 with weld 110. Large diameter portion 170 of bore 116 has plug 162 positioned on shoulder 168. O-rings 164 and 166 provide sealing of plug 162 within bore 116 until pressure from line 74 blows-out or ruptures plug 162 as explained previously.

Thus it will be appreciated that the present invention provides an improvement over the system shown in my prior '506 patent by allowing inexpensive water to be used along with chemicals in delaying ignition of a fire or in the extinguishing of a fire at a well site thereby improving safety, minimizing possible loss of equipment, and also minimizing permanent damage to equipment at the well site including the drilling rig.

Although a preferred embodiment of the invention has been shown and described, it will be appreciated by those skilled in the art to which the present invention pertains that modifications and improvements may be made without departing from the spirit of the invention as defined by the claims.

I claim:

1. A system for delaying the ignition of and assisting in the extinguishing of a fire around the oil pipe stem on an oil drilling rig during a blowout by injecting chemicals and untreated water into the flow of hydrocarbons in the drill stem before the hydrocarbons are exposed to the ambient at the well head, the drilling rig having a stack of safety devices for horizontally closing off the well located between the well casing and the rig floor and below the mud return line element including in combination spool apparatus incorporated as an in-line section of the stack above the safety devices but below the rig floor and having valve means for allowing the injection of pressurized chemicals and untreated water directly into the flow of hydrocarbons in the drill pipe before the hydrocarbons are exposed to the atmosphere above the safety devices, said spool apparatus further including steel ring flange seal means at each vertical end of said spool apparatus for fixedly attaching the ends of said spool apparatus at the bottom to the uppermost one of the safety devices and at the top to the mud return line element, a plurality of check valves located equidistant from one another around the exterior, circumferential surface of said spool apparatus, conduit means attached to said plurality of check valves on said spool apparatus for transporting the chemicals and untreated water from storage to said spool apparatus, a storage source of chemicals and untreated water associated with the rig and operatively connected to said conduit means, and activation means associated with said conduit means for activating the system for delivery of the chemicals and untreated water when desired to said spool apparatus and into the flow of hydrocarbons wherein the improvement comprises said plurality of check valves acting to reduce radiant heat by injecting the untreated water into the flow of hydrocarbons in the drill stem before the hydrocarbons are exposed to the ambient at the well head, each of said plurality of check valves including an elongated bore having a chemical inlet connected to said source of chemicals and a water inlet connected to said source of untreated water, a spring positioned in said bore, a ball positioned on one end of said spring near said chemical inlet, a cylindrical hollow member having first and second inside diameters and positioned substantially perpendicular to said elongated bore, and a plug normally sealed with a plurality of O-rings in said cylindrical hollow member whereby blow-out or rupture of said plug allow communication between said cylindrical hollow member and said elongated bore.

* * * * *